US009377715B2

(12) United States Patent
Watanabe et al.

(10) Patent No.: US 9,377,715 B2
(45) Date of Patent: Jun. 28, 2016

(54) DEVELOPING UNIT AND PROCESS CARTRIDGE

(71) Applicant: CANON KABUSHIKI KAISHA, Tokyo (JP)

(72) Inventors: Yasunari Watanabe, Suntou-gun (JP); Takashi Hiramatsu, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/653,200

(22) PCT Filed: Dec. 13, 2013

(86) PCT No.: PCT/JP2013/007343

§ 371 (c)(1),
(2) Date: Jun. 17, 2015

(87) PCT Pub. No.: WO2014/097593

PCT Pub. Date: Jun. 26, 2014

(65) Prior Publication Data

US 2015/0331359 A1 Nov. 19, 2015

(30) Foreign Application Priority Data

Dec. 20, 2012 (JP) ..... 2012-278518
Dec. 20, 2012 (JP) ..... 2012-278519

(51) Int. Cl.
*G03G 15/08* (2006.01)
*G03G 15/09* (2006.01)

(52) U.S. Cl.
CPC ..... *G03G 15/0881* (2013.01); *G03G 15/0817* (2013.01); *G03G 15/0942* (2013.01)

(58) Field of Classification Search
CPC ..... G03G 15/0881; G03G 15/0817; G03G 15/0942
See application file for complete search history.

(56) References Cited

U.S. PATENT DOCUMENTS 5,187,326 A * 2/1993 Shirai ..... G03G 15/0942 399/104
5,742,876 A * 4/1998 Bogoshian ..... G03G 15/0942 399/104

(Continued)

FOREIGN PATENT DOCUMENTS

JP S54-43027 A 4/1979
JP S55-18656 A 2/1980

(Continued)

*Primary Examiner* — G. M. Hyder

(74) *Attorney, Agent, or Firm* — Canon USA, Inc., IP Division

(57) ABSTRACT

The present invention relates to a developing unit including a developer container accommodating a developer; a developer bearing member bearing the developer supplied from the developer container; a magnetic-field generation member disposed in the developer bearing member, the magnetic-field generation member having a magnetic-field generation area generating a magnetic field for attracting the developer to the developer bearing member; and a sealing member disposed at the developer container, the sealing member preventing the developer from leaking from a gap between a longitudinal end of the developer bearing member and the developer container. An end of the magnetic-field generation area of the magnetic-field generation member is disposed inside an inner end of the sealing member in the longitudinal direction of the developer bearing member. The developer bearing member develops a latent image formed on the image bearing member with the developer while keeping in contact with the image bearing member.

36 Claims, 9 Drawing Sheets

(56) References Cited

U.S. PATENT DOCUMENTS

| | | | | |
|---|---|---|---|---|
| 2005/0152718 | A1 | 7/2005 | Osada | |
| 2007/0053713 | A1* | 3/2007 | Kawai | G03G 15/0817 399/103 |
| 2012/0269553 | A1* | 10/2012 | Yoshizawa | G03G 15/0812 399/222 |

FOREIGN PATENT DOCUMENTS

| | | | |
|---|---|---|---|
| JP | H10-39630 | A | 2/1998 |
| JP | 2001-92201 | A | 4/2001 |
| JP | 2005-173485 | A | 6/2005 |
| JP | 2006-208552 | A | 8/2006 |

* cited by examiner

DEVELOPING UNIT AND PROCESS CARTRIDGE

TECHNICAL FIELD

The present invention relates to a developing unit that develops a latent image (an object to be developed) on an image bearing member. The present invention also relates to a process cartridge equipped with the developing unit and an image forming apparatus (an image recording apparatus) equipped with the developing unit, such as a printer.

BACKGROUND ART

A widely used example of a developing method using a magnetic one-component developer is a magnetic non-contact developing method (for example, see PTL 1 and PTL 2).

With the magnetic non-contact developing method, a developing sleeve (a developer bearing member) accommodating a magnet bears a developer. A photoconductor is opposed to the surface of the developing sleeve with a predetermined minute gap therebetween, and the developer is splashed from the developing sleeve toward the photoconductor to perform developing. The developer in the developing unit is conveyed to the developing sleeve by a mechanical stirring mechanism or gravitation. The magnetic one-component developer is supplied to the developing sleeve with a fixed magnetic force of a magnet accommodated in the developing sleeve.

Another developing method using the magnetic one-component developer is a magnetic contact developing method (see PTL 3). This magnetic contact developing method has both of the characteristics of a non-magnetic contact developing method (for example, PTL 4) and the above magnetic non-contact developing method. The magnetic contact developing method forms an elastic layer on the surface of the developing sleeve to keeping the developing sleeve and the photoconductor in contact with each other in contrast to the above magnetic non-contact developing method. The magnetic contact developing method is also configured such that a magnet is disposed in the developing sleeve, and the developer is born on the surface of the developing sleeve by the magnetic force of the magnet, as with the non-magnetic contact developing method.

The magnetic non-contact developing method, which is generally employed when a magnetic one-component developer is used, holds a magnetic developer on the surface of the developer developing sleeve by the action of the magnetic force of the magnet accommodated in the developing sleeve. End sealing members are provided at both ends of the developing sleeve. The end sealing members seal gaps between the developing sleeve and the developing unit to prevent the developer from leaking outside the developing unit.

However, the action of the magnetic force of the magnet accommodated in the developing sleeve on the areas in which the end sealing members are provided may cause the developer to enter the gaps between the end sealing members and the developing sleeve. This developer may be firmly fixed to the developing sleeve between the end sealing members and the developing sleeve to form gaps between the end sealing members and the developing sleeve, thus causing developer leakage or the like. This is one of large technical problems due to the recent increase in the speed of image formation and the life of cartridges.

Furthermore, for the magnetic non-contact developing method as described above, a sealing member that is not in contact with the developing sleeve has been proposed to prevent toner from leaking through a gap between a developer container and the longitudinal ends of the developing sleeve to the outside of the developer container. PTL 5 proposes a method in which magnetic sealing members are disposed so as to oppose the ends of the developing sleeve. This is a method in which the magnetic sealing members are disposed at the ends of the developing sleeve with a predetermined gap therebetween, and toner is held by the magnetic sealing members with the magnetic force thereof. In other words, by holding toner that is moving outside the developer container with the magnetic sealing members, leakage of the toner can be prevented.

However, the developing unit has a regulating blade serving as a developer regulating member for regulating the amount of the toner to be born on the developing sleeve to a fixed amount. The magnetic sealing members are disposed outside the regulating blade.

However, it is difficult to make the end faces of the regulating blade and the side faces of the magnetic sealing members close contact with each other because the magnetic sealing members generally have high rigidity. Thus, small gaps may be sometime formed between the end faces of the regulating blade and the magnetic sealing members. The toner born on the developing sleeve in the gaps is located outside the regulating blade and is not regulated by the regulating blade. In other words, the gaps between the end faces of the regulating blade and the magnetic sealing members cause the amount of toner born on the developing sleeve (developer amount) in the gaps to be increased, as compared with that in the other areas. Furthermore, since the toner outside the regulating blade is not subjected to friction due to the regulating blade, the toner resists being charged with electricity, thus having a low electrical charge. Thus, the toner born on the developing sleeve in the areas between the end faces of the regulating blade and the magnetic sealing members can be easily moved from these areas to the photoconductor. Such toner may move to an area of the photoconductor in which no developed image is to be formed, thus causing so-called fogging.

In other words, both of the use of the end sealing members that are in contact with the developing sleeve as sealing members and the use of magnetic sealing members that are not in contact with the developing sleeve may cause the developer born on the developing sleeve to splash or leak.

Furthermore, in the case where the non-contact sealing members are used as sealing members, another sealing member (hot-melt adhesive) is sometimes provided between the magnetic sealing members and the ends of the regulating blade. PTL 6 proposes a method for preventing a developing sleeve from bearing toner outside the ends of the regulating blade by filling the gaps between the magnetic sealing members and the regulating blade with hot melt adhesive.

However, with the contact end sealing members, excessively enhancing the adhesiveness between the end sealing members and the developing sleeve increases the frictional force generated between the developing sleeve and the end sealing members, thus increasing a torque for rotating the developing sleeve. Thus, the developer sealing performance of the end sealing members has to be ensured while the adhesiveness between the developing sleeve and the end sealing members and the torque for rotating the developing sleeve are balanced. This requires sufficiently enhancing the dimensional accuracy of the developing sleeve, the end sealing members, and so on.

Furthermore, with the magnetic sealing members, providing another sealing member (hot-melt adhesive) between the magnetic sealing members and the ends of the regulating blade may increase the cost.

CITATION LIST

Patent Literature

PTL 1: Japanese Patent Laid-Open No. 54-43027
PTL 2: Japanese Patent Laid-Open No. 55-18656
PTL 3: Japanese Patent Laid-Open No. 2005-173485
PTL 4: Japanese Patent Laid-Open No. 2001-92201
PTL 5: Japanese Patent Laid-Open No. 10-39630
PTL 6: Japanese Patent Laid-Open No. 2006-208552

SUMMARY OF INVENTION

The present invention is proposed in consideration of the above circumstances and is characterized by adopting a magnetic contact method instead of the magnetic non-contact developing method. This prevents the developer from splashing or leaking from a developing unit or a process cartridge with a simple configuration. In other words, the present invention prevents a developer born on a developer bearing member from moving to an image bearing member or leaking outside from between the developer bearing member and a sealing member.

SOLUTION TO PROBLEM

A developing unit according to a first aspect of the present invention includes a developer container accommodating a developer; a developer bearing member configured to bear the developer supplied from the developer container; a magnetic-field generation member disposed in the developer bearing member, the magnetic-field generation member having a magnetic-field generation area generating a magnetic field for attracting the developer to the developer bearing member; and at least one sealing member disposed at the developer container, the sealing member being configured to prevent the developer from leaking from a gap between a longitudinal end of the developer bearing member and the developer container. An end of the magnetic-field generation area of the magnetic-field generation member is disposed inside an inner end of the sealing member in the longitudinal direction of the developer bearing member. The developer bearing member develops a latent image formed on the image bearing member with the developer while keeping in contact with the image bearing member.

A developing unit according to a second aspect of the present invention includes a developer container accommodating a developer; a developer bearing member configured to bear the developer supplied from the developer container; a magnetic-field generation member disposed in the developer bearing member, the magnetic-field generation member having a magnetic-field generation area generating a magnetic field for attracting the developer to the developer bearing member; at least one sealing member disposed at the developer container, the sealing member being configured to prevent the developer from leaking from a gap between a longitudinal end of the developer bearing member and the developer container; and a developer regulating member configured to regulate the amount of the developer born on the developer bearing member. An end of the magnetic-field generation area of the magnetic-field generation member is disposed inside an end of the developer regulating member in the longitudinal direction of the developer bearing member. The developer bearing member develops a latent image formed on the image bearing member with the developer while keeping in contact with the image bearing member.

A process cartridge that can be attached to and detached from an image forming apparatus main body according to a third aspect of the present invention includes an image bearing member on which a latent image is formed; and a developing unit for developing the latent image. The developing unit includes a developer container accommodating a developer; a developer bearing member configured to bear the developer supplied from the developer container; a magnetic-field generation member disposed in the developer bearing member, the magnetic-field generation member having a magnetic-field generation area generating a magnetic field for attracting the developer to the developer bearing member; and at least one sealing member disposed at the developer container, the sealing member being configured to prevent the developer from leaking from a gap between a longitudinal end of the developer bearing member and the developer container. An end of the magnetic-field generation area of the magnetic-field generation member is disposed inside an inner end of the sealing member in the longitudinal direction of the developer bearing member. The developer bearing member develops a latent image formed on the image bearing member with the developer while keeping in contact with the image bearing member.

A process cartridge that can be attached to and detached from an image forming apparatus main body according to a fourth aspect of the present invention includes an image bearing member on which a latent image is formed; and a developing unit for developing the latent image. The developing unit includes a developer container accommodating a developer; a developer bearing member configured to bear the developer supplied from the developer container; a magnetic-field generation member disposed in the developer bearing member, the magnetic-field generation member having a magnetic-field generation area generating a magnetic field for attracting the developer to the developer bearing member; at least one sealing member disposed at the developer container, the sealing member being configured to prevent the developer from leaking from a gap between a longitudinal end of the developer bearing member and the developer container; and a developer regulating member configured to regulate the amount of the developer born on the developer bearing member. An end of the magnetic-field generation area of the magnetic-field generation member is disposed inside an end of the developer regulating member in the longitudinal direction of the developer bearing member. The developer bearing member develops a latent image formed on the image bearing member with the developer while keeping in contact with the image bearing member.

Further features of the present invention will become apparent from the following description of exemplary embodiments with reference to the attached drawings.

DESCRIPTION OF EMBODIMENTS

First Embodiment

Figure 1:
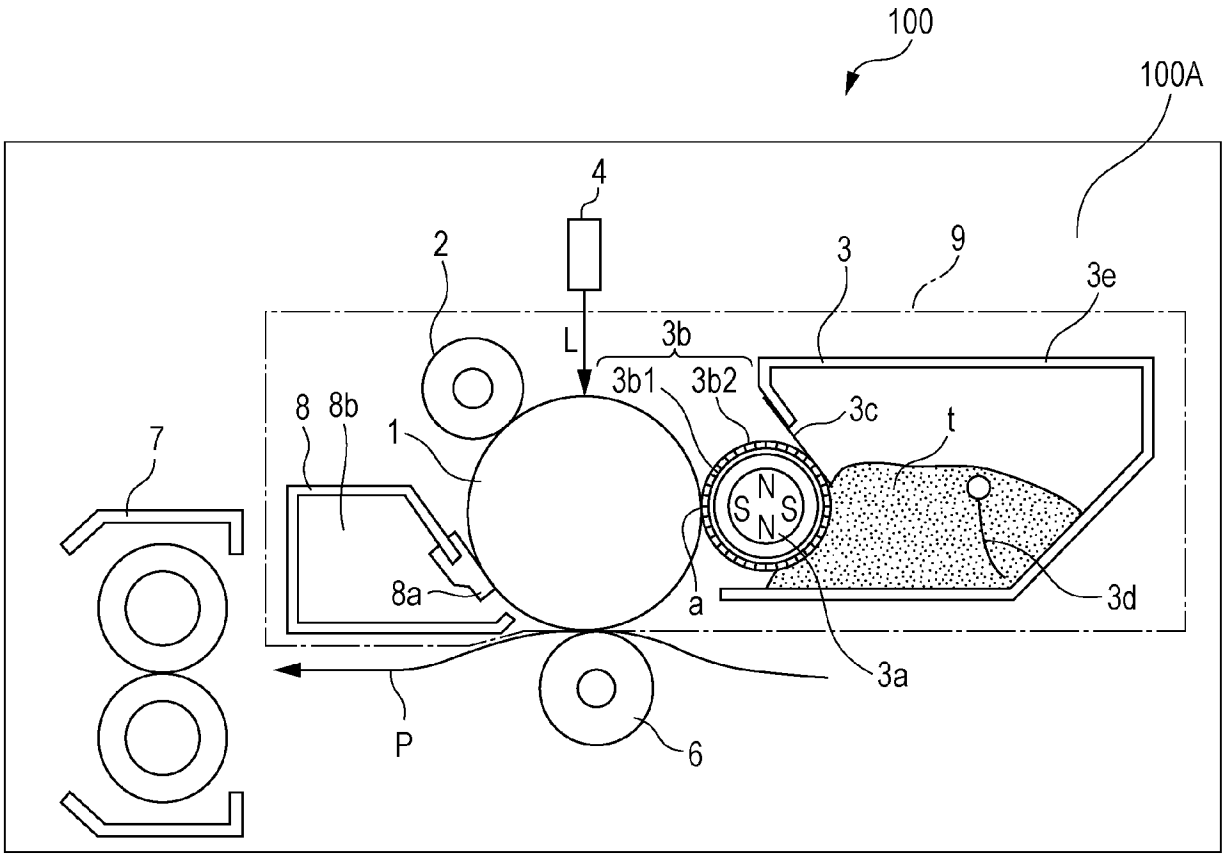
FIG. 1 is a diagram illustrating, in outline, the configuration of an image forming apparatus.
Figure 2:
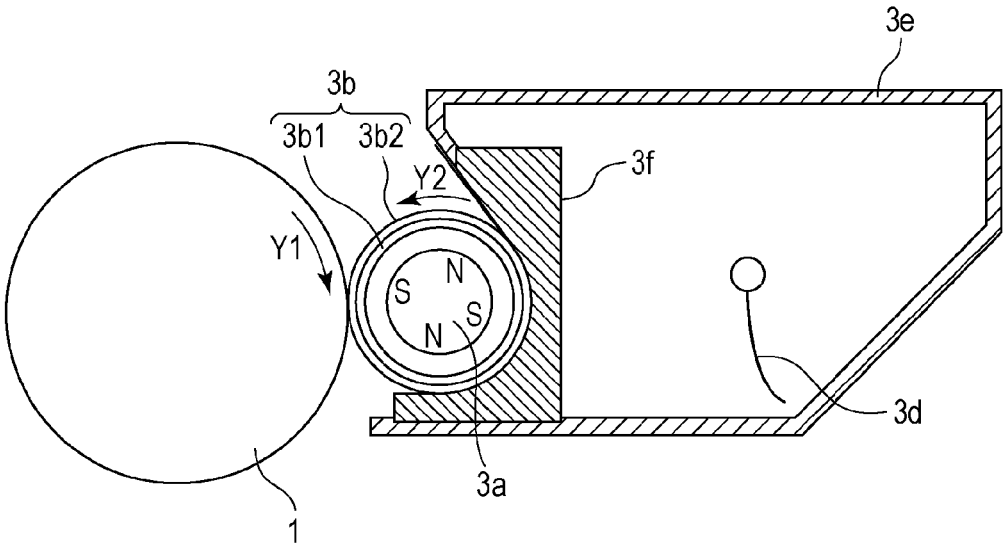
FIG. 2 is a diagram illustrating, in outline, the configuration of a developing unit.

FIGS. 1 and 2 are diagrams illustrating, in outline, the configuration of an image forming apparatus (an image recording apparatus) 100. This image forming apparatus 100 is a laser printer using electrophotographic processing. The image forming apparatus 100 of the first embodiment uses a magnetic contact developing method as a developing method, which will be described later.

Reference sign 1 denotes an image bearing member, which is a negative-polarity organic photoconductor (OPC) of a rotary drum type with a diameter of 24 mm (a negative photoconductor, hereinafter referred to as a photosensitive drum). This photosensitive drum 1 is rotationally driven clockwise along an arrow Y1 in FIG. 2 at a fixed circumferential speed of 85 mm/sec (=processing speed PS, printing speed).

Reference sign 2 denotes a charging roller serving as charging means for the photosensitive drum 1. This charging roller 2 is an electrically conductive elastic roller, which rotates with the rotation of the photosensitive drum 1 in the first embodiment.

The charging roller 2 is in contact with the photosensitive drum 1 to apply a direct-current voltage of −1,300 V as a charging bias to uniformly charge the surface of the photosensitive drum 1 to a charge polarity (dark polarity) of −700 V.

Reference sign 4 denotes a laser beam scanner (an exposure unit) including a laser diode polygon mirror. The laser power is adjusted so that, when the uniformly charged entire surface of the photosensitive drum 1 is exposed to light L, the polarity of the surface of the photosensitive drum 1 becomes −150 V.

This scanning light L forms a static latent image corresponding to target image information on the surface of the rotating photosensitive drum 1.

Reference sign 3 denotes a developing unit (developing unit) for developing the photo static latent image on the sensitive drum 1. Toner t is a developer for developing a latent image and assumes a certain charge due to frictional charge. Here, developing bias voltage is applied between a developing roller sleeve 3*b* serving as a developer bearing member (developer-bearing conveying member, toner bearing member) and the photosensitive drum 1 by a developing bias power source (not shown). The toner t moves from developing roller sleeve 3*b* to the photosensitive drum 1 in the developing section (developing area) a to develop the static latent image on the photosensitive drum 1 using this developing bias. This developing unit 3 will be described later.

Reference sign 6 denotes a transfer roller serving as contact transfer means, which is in pressure-contact with the photosensitive drum 1 by a predetermined force. This transfer section is fed with a transferred material P or a recording medium from a paper feed section (not shown) at a predetermined timing, and a predetermined transfer bias voltage is applied to the transfer roller 6. This causes a toner image (a developer image) on the photosensitive drum 1 to be sequentially transferred onto the surface of the transferred material P fed into the transfer nip.

Reference sign 7 denotes a fixing unit of a thermally fixing system or the like. The transferred material P to which the toner image is transferred in the transfer section is separated from the surface of the rotating photosensitive drum 1 and is guided to this fixing unit 7, where the toner image is fixed, and is discharged outside the image forming apparatus 100 as an image formed object (print copy).

Reference sign 8 denotes a photosensitive-drum cleaning unit (a drum cleaner), which scrapes transfer toner remaining on the photosensitive drum 1 with a cleaning blade 8*a* and collects the remaining toner into a waste-toner container 8*b*.

The photosensitive drum 1 is again charged by the charging unit (charging roller 2) and is repeatedly used for image formation.

Reference sign 9 denotes a process cartridge in which the photosensitive drum 1, the charging roller 2, the developing unit 3, and the drum cleaner 8 are integrated and which is detachable from the main body 100A of the image forming apparatus 100.

The developing unit 3 of the first embodiment will be described. The developing roller sleeve 3*b* is a developer bearing member (a developer bearing/conveying member) that accommodates a magnet roller 3*a* serving as a magnetic-field generation member and bears the toner (developer) t on the surface thereof. The developing roller sleeve 3*b* is a roller in which a non-magnetic electrically conductive elastic layer 3*b*2 with a thickness of 1.0 mm is formed on an aluminum cylinder (aluminum sleeve) 3*b*1 with a diameter of 12 mm. Hereinafter, the developing roller sleeve 3*b* is simply referred to as a developing sleeve 3*b*. The developing sleeve 3*b* rotates along an arrow Y2.

The electrically conductive elastic layer 3*b*2 can be formed of rubber containing an electrical conductor and has, in this embodiment, a two-layer structure including a base layer formed of silicon rubber that is in contact with the aluminum cylinder 3b1 and a surface layer formed of urethane rubber on the silicon rubber.

Since the electrically conductive elastic layer 3b2, if excessively thick, decreases the action of the magnetic force of the magnet roller 3a, the electrically conductive elastic layer 3b2 may be designed in consideration of balance to the magnetic force. The developing sleeve 3b is disposed in an opening 3g of a developer container 3e so as to oppose the photosensitive drum 1 and be in contact with the photosensitive drum 1 under a fixed pressure. The opening 3g of the developer container 3e extends along the longitudinal direction of the developing sleeve 3b. The longitudinal direction of the developing sleeve 3b is a direction in which the rotational axis of the developing sleeve 3b extends or a direction parallel to this direction. The longitudinal direction is hereinafter the longitudinal direction of the developing sleeve 3b unless otherwise noted.

The magnet roller 3a is a roller formed of a magnet fixed to the developer container 3e and serves as a magnetic-field generation member whose substantially entire area is a magnetic-field generation area. The magnet roller 3a generates a magnetic field for bearing the toner t on the surface of the developing sleeve 3b, which will be described later.

The magnet roller 3a has four magnetic poles arranged along the circumferential direction. These magnetic poles generate magnetic forces at predetermined peak densities at a developing section a, a conveying section, a supply section, and a collecting section.

Specifically, the magnet roller 3a has S-pole, N-pole, S-pole, and N-pole from the developing section a downstream in the rotating direction of the developing sleeve 3b, which generate peak densities of the magnetic fields at the developing section a (S-pole), the collecting section (N-pole), the supply section (S-pole), and the conveying section (N-pole). Part of the toner t that has reached the developing section a moves from the developing sleeve 3b to the photosensitive drum 1, where it develops a latent image formed on the photosensitive drum 1. The toner t that is not consumed in the developing section a moves to the collecting section located downstream from the developing section a in the rotating direction of the developing sleeve 3b and is collected into the developer container 3e. The collecting section carries a peak flux density of the magnetic field, thus preventing the toner t in the developer container 3e from blowing to the outside.

The toner t that has reached the collecting section in this way is conveyed downstream of the collecting section, that is, the supply section located in the developer container 3e. The magnetic field that the magnet roller 3b forms in the supply section attracts the toner t in the developer container 3e to the developing sleeve 3b. Thus, the toner t that has reached the collecting section without being consumed in the developing section a and toner t that is newly supplied in the supply section are mixed. The toner t thus mixed and born on the developing sleeve 3b is conveyed to the conveying section located downstream of the supply section and reaches the developing section again. Thus, continuous supply of the toner t to the developing section a is achieved.

The toner t used as a developer is a one-component magnetic toner (a magnetic one-component developer), which is, in this embodiment, produced by suspension polymerization, and whose average circularity is 0.976.

The toner t is given a fixed thickness by passing between a regulating blade 3c and the developing sleeve 3b in the process of being conveyed on the developing sleeve 3b while receiving the magnetic force of the magnet roller 3a. In other words, the regulating blade 3c is a developer regulating member that regulates the thickness of the toner layer formed on the developing sleeve 3b. The toner t is charged with the electrical charge by the regulating blade 3c.

Reference sign 3d denotes a stirring member that circulates the toner t in the developer container 3e to sequentially convey the toner t into the magnetic-force reach area in the vicinity of the developing sleeve 3b.

The toner t that has coated the developing sleeve 3b is conveyed to the developing section (developing area) a, at which the photosensitive drum 1 and the developing sleeve 3b oppose each other, by the rotation of the developing sleeve 3b. The developing sleeve 3b is given a developing bias voltage (a DC voltage of −450V) from a developing bias power source (not shown). The developing sleeve 3b is driven with respect to the photosensitive drum 1 at a predetermined circumferential speed. This causes the static latent image on the photosensitive drum 1 to be reversely developed with the toner t.

The most important sections of the magnet roller 3a of the developing method of the first embodiment are the supply section and the collecting section. The toner t is supplied to the surface of the developing sleeve 3b due to the magnetic force of the magnet roller 3a that acts on the magnetic toner t. The toner t supplied to the developing sleeve 3b is electrically charged through the regulating blade 3c and is held on the developing sleeve 3b.

The arrangement of the magnetic poles of the magnet roller 3a described above is merely an example, and any arrangement other than that may be employed. Even if the magnetic poles of the magnet roller 3a in the developing section and the conveying section have no peak flux density, there is no problem.

Figure 3A:
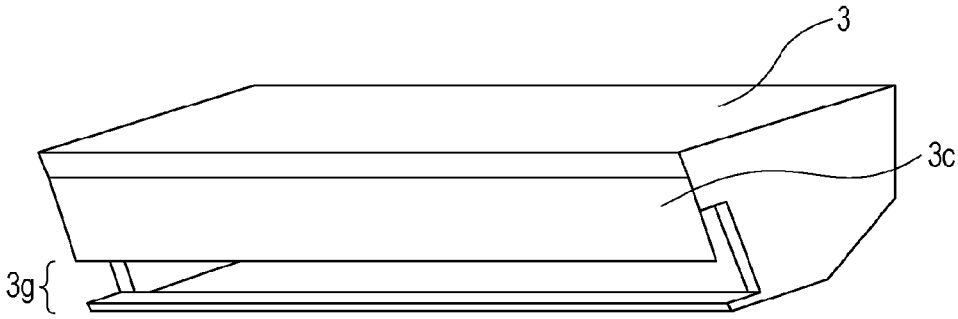
FIG. 3A is a diagram illustrating, in outline, the configuration of the developing unit.
Figure 3B:
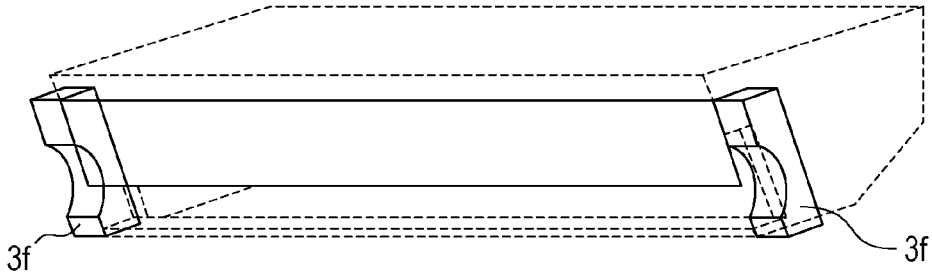
FIG. 3B is a diagram illustrating, in outline, the configuration of the developing unit.

To prevent leakage of the toner t from the vicinity of the ends of the developing sleeve 3b, that is, toner leakage, end sealing members 3f that are in contact with the longitudinal ends of the developing sleeve 3b are provided (see FIG. 3B).

Figure 3C:
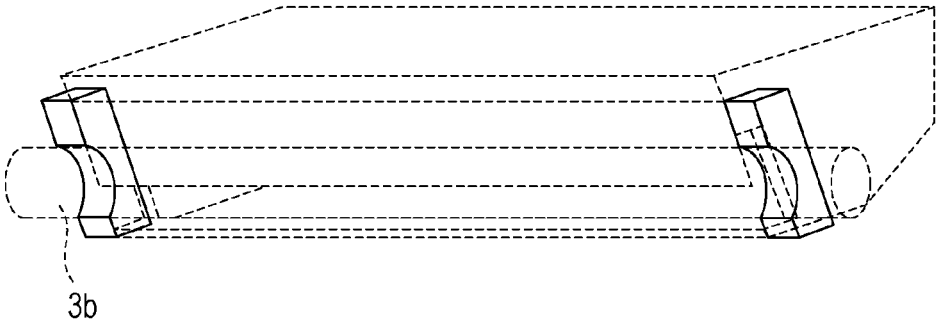
FIG. 3C is a diagram illustrating, in outline, the configuration of the developing unit.

Here, the ends of the opening 3g of the developer container 3e will be further described with reference to FIGS. 3A to 3C. Since the following description is about the ends of the opening 3g of the developing unit 3, the developing sleeve 3b is omitted in FIGS. 3A and 3B. FIG. 3C shows a diagram including the developing sleeve 3b.

As shown in FIG. 3A, the developing unit 3 has the opening 3g. The toner t is conveyed toward the opening 3g by the magnetic force of the magnet roller 3a and the stirring member 3d. The end sealing members 3f are disposed at both ends of the opening 3g, as shown in FIG. 3B. As shown in FIG. 3C, the end sealing members 3f and the surface of the developing sleeve 3b are in close-contact with each other to ensure the sealing performance of the toner t, thereby preventing the toner t from leaking outside. The side surfaces of the end sealing members 3f are in contact with both end faces of the regulating blade 3c to prevent the toner t from leaking from both ends of the regulating blade 3c. In this case, additional sealing members may be provided at the ends of the end sealing members 3f to further ensure the sealing performance. Alternatively, the end sealing members 3f and the regulating blade 3c may be overlapped to ensure the sealing performance.

The end sealing members 3f may be formed of a fabric material, such as wool felt and polytetrafluoroethylene (PTEE) pile, or a foamed material, such as polyurethane and sponge rubber. Wool felt is used in the first embodiment.

Sizes and Arrangement of Components of First Embodiment

Next, the relationship between the longitudinal length of the magnet roller 3a and the disposition of the end sealing members 3f of the first embodiment will be described. The first embodiment is characterized in that the ends of the magnet roller 3a are disposed inside the inner ends of the end sealing members 3*f* in the longitudinal direction of the developing sleeve 3*b*. In other words, the magnet roller 3*a* is shorter than the distance between the two end sealing members 3*f* disposed at both ends of the opening 3*g*. This prevents the toner t from leaking from the gaps between the developing sleeve 3*b* and the end sealing members 3*f* to the outside of the developing unit 3.

Figure 4A:
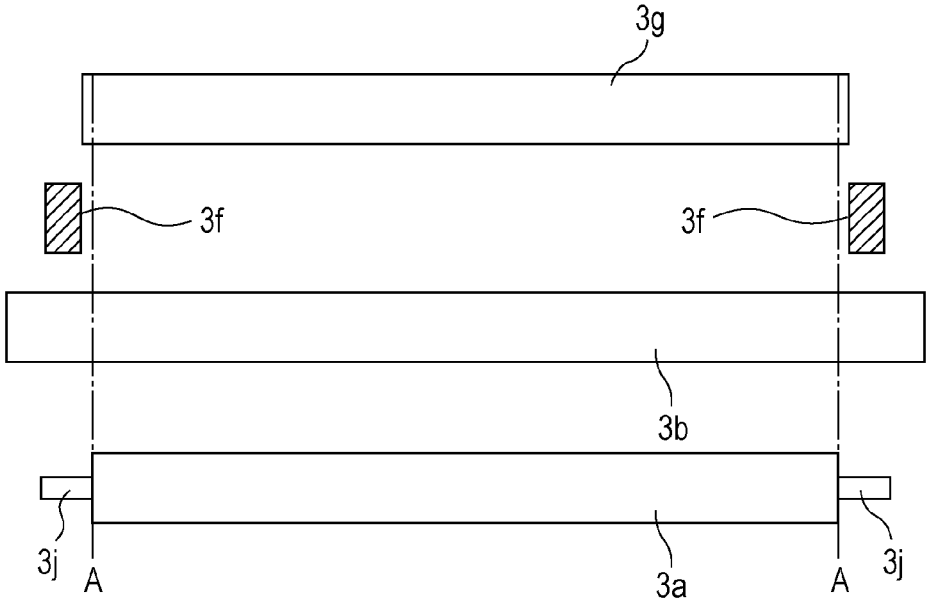
FIG. 4A is a diagram illustrating the positions of the components of a developing unit according to a first embodiment.

FIG. 4A shows the longitudinal positional relationship among the opening 3*g*, the end sealing members 3*f*, the developing sleeve 3*b*, and the magnet roller 3*a*. In FIG. 4A, reference sign 3*j* denotes the shaft of the magnet roller 3*a*, which serves as a support for supporting the magnet roller 3*a* in the developer container 3*e* (see FIG. 1). In other words, the shaft 3*j* is fixed to the developer container 3*e*, so that the magnet roller 3*a* is fixed to the developer container 3*e*.

Figure 4B:
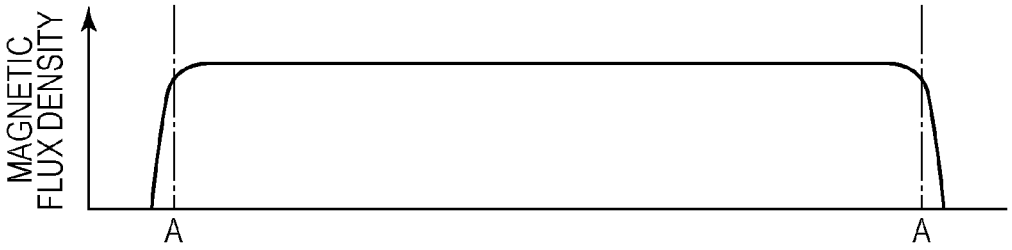
FIG. 4B is a diagram illustrating a magnetic flux density in the first embodiment.

FIG. 4B shows the density distribution of a magnetic flux that the magnet roller 3*a* generates in the longitudinal direction (in teslas). This shows the measurements of the density of a magnetic flux generated at the developing section a (see FIG. 1) on the surface of the developing sleeve 3*b*.

The distribution of the magnetic flux density decreases in the areas outside the longitudinal ends (A in FIG. 4A) of the magnet roller 3*a*. This characteristic is common to the developing section a, the conveying section, the supply section, and the collecting section. As described above, the toner t is conveyed over the developing sleeve 3*b* while receiving the magnetic force of the magnet roller 3*a*. Thus, the amount of the toner t on the developing sleeve 3*b* also depends on the magnitude of the magnetic force of the magnet roller 3*a*. The amount of the toner t decreases as the magnetic force decreases.

The first embodiment is configured such that the ends of the magnet roller 3*a* do not reach the positions of the end sealing members 3*f*. Thus, the magnetic force that attracts the toner t to the developing sleeve 3*b* decreases on the surface of the developing sleeve 3*b* at the positions of the end sealing members 3*f*. The decrease in the magnetic force of the magnet roller 3*a* decreases the force of bearing the toner t on the developing sleeve 3*b*. Since the toner t is attracted to a larger magnetic force, the toner t on the developing sleeve 3*b* is less prone to moving to the ends of the developing sleeve 3*b* at which the magnetic force decreases.

In other words, this makes it difficult to move the toner t to the positions of the end sealing members 3*f*. This action decreases the amount of toner t that enters the end sealing members 3*f*, thus preventing the toner t from leaking outside the developing unit 3 from between the end sealing members 3*f* and the developing sleeve 3*b*. This can also prevent the toner t from being fixed between the end sealing members 3*f* and the developing sleeve 3*b*, thus reliably preventing the toner t from leaking using the end sealing members 3*f*.

Difference Between First Embodiment and Non-Contact Developing Method

Adopting the contact developing method allows the first embodiment to achieve the above relationship between the longitudinal length of the magnet roller 3*a* and the disposition of the end sealing members 3*f*. The relationship will be specifically described hereinbelow.

With the non-contact developing method that is often used as a developing method using magnetic toner, since the developing sleeve and the photoconductor are separated from each other, the toner is splashed from the developing sleeve toward the photoconductor. At that time, the splashing of the toner is controlled by balancing the magnitude of the magnetic force that acts on the surface of the developing sleeve and the voltage applied to the developing sleeve (a developing bias).

More specifically, with the non-contact developing method, a developing bias in which an AC bias is superposed on a DC bias is applied to the developing sleeve to form an electric field between the developing sleeve and the photosensitive drum. A force due to the electric field acts upon the charged toner. If this force exceeds the magnetic force of the magnet accommodated in the developing sleeve, the toner held on the developing sleeve splashes to the photosensitive drum. In other words, by splashing toner (a developer) toward a latent image formed on the photosensitive drum, the latent image can be developed.

Thus, with the non-contact developing method, if some of the surface of the developing sleeve is under a low magnetic force of the magnet, the force with which the toner is held on the developing sleeve is also small. This causes a larger amount of toner than a desired amount to splash from the developing sleeve to the photosensitive drum. This causes defective images, such as fogging (adhesion of toner to a portion at which no image is to be formed). In other words, the non-contact developing method needs to increase the length of the magnet roller disposed in the developing sleeve sufficiently so as not to form a portion where the magnetic force due to the magnet roller decreases on the developing sleeve. Thus, the ends of the magnet roller cannot be disposed inside the inner ends of the end sealing members, in contrast to the first embodiment.

In contrast, the first embodiment uses the contact developing method, not the conventional non-contact developing method, although using magnetic toner. With this contact developing method, the developing sleeve 3*b* is in contact with the photosensitive drum 1, as described above, and applies only a DC bias to the developing sleeve 3*b*. Since the photosensitive drum 1 and the developing sleeve 3*b* are in contact, a larger electric field acts between the photosensitive drum 1 and the developing sleeve 3*b* than that of the non-contact developing method.

In other words, with the contact developing method, a dominant force acting on the toner t when developing the latent image on the photosensitive drum 1 is an electric field, and the action of the magnetic force of the magnet roller 3*a* is smaller. Thus, the difference in the force acting on the toner t between a portion on which the magnetic force of the magnet roller 3*a* acts and a portion on which no magnetic force acts is small, and the difference in influence that the magnet roller 3*a* exerts in terms of generation of fogging is also remarkably small.

In other words, if the developing bias and the like are appropriately set so as not to generate fogging at the center of the developing sleeve 3*b* in the longitudinal direction, there is a low possibility of generating fogging also in the vicinity of the end sealing members 3*f* at which the magnetic force of the magnet roller 3*a* decreases.

Comparative Example

Next, a comparative example in which the positional relationship and the dimensional relationship between the magnet roller 3*a* and the end sealing members 3*f* in the longitudinal direction are different from the present application will be described with reference to FIGS. 5A and 5B.

Figure 5A:
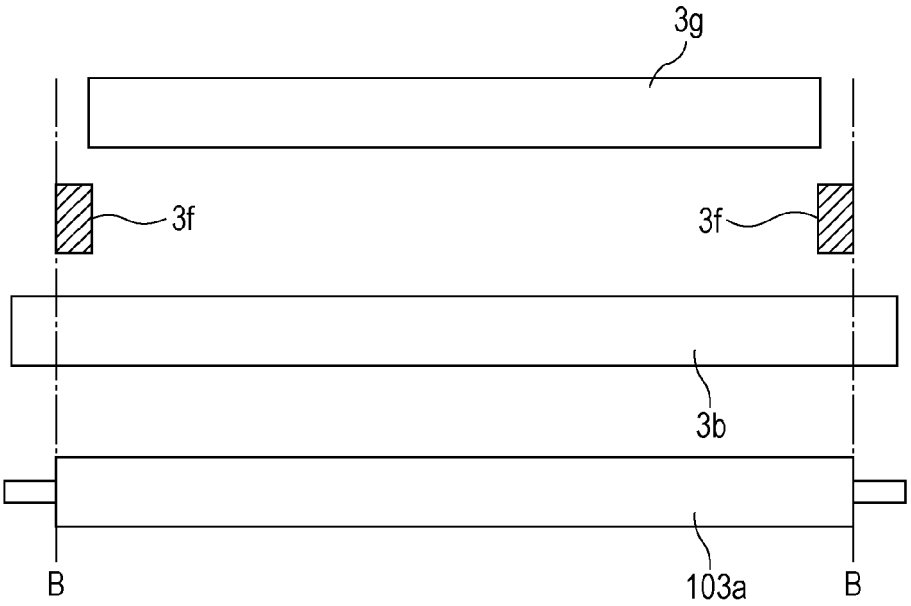
FIG. 5A is a diagram illustrating the positions of the components of a developing unit of a comparative example.
Figure 5B:
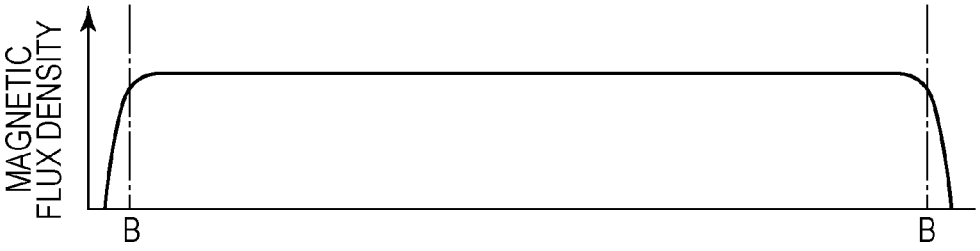
FIG. 5B is a diagram illustrating a magnetic flux density in the comparative example.

FIGS. 5A and 5B are diagrams illustrating the comparative example, showing the relationship between the disposition of the components in the longitudinal direction and the magnetic flux density of a magnet roller 103*a*. FIG. 5A shows the positional relationship among the opening 3*g*, the end sealing members 3*f*, the developing sleeve 3*b*, and the magnet roller 103*a* of the comparative example in the longitudinal direction of the developing sleeve 3*b*.

In this comparative example, the ends of the magnet roller 103*a* are provided outside the inner ends of the end sealing members 3*f* in contrast to the first embodiment.

In FIG. 5A, reference sign B denotes the positions of the ends of the magnet roller 103*a*. FIG. 5B shows the distribution of the magnetic flux density in the longitudinal direction of the magnet roller 103*a*.

Since the end sealing members 3*f* are located outside the opening 3*g* of the developer container 3*e* in the longitudinal direction, the toner t is not directly supplied, at the positions of the end sealing members 3*f*, from the developer container 3*e* to the developing sleeve 3*b*.

However, the toner t on the developing sleeve 3*b* at the positions of the end sealing members 3*f* is subjected to the magnetic force of the magnet roller 103*a*. Therefore, the toner t is also conveyed onto the developing sleeve 3*b*, on which the end sealing members 3*f* are provided, by the magnetic force of the magnet roller 103*a*. The toner t that has entered the gaps between the end sealing members 3*f* and the developing sleeve 3*b* is subjected to a friction with the developing sleeve 3*b*. This causes the toner t at this position to be firmly fixed to the surface of the developing sleeve 3*b*. The fixed toner t forms gaps between the end sealing members 3*f* and the developing sleeve 3*b*, which may cause toner leakage. This may also influence the amount of pressure of the developing sleeve 3*b* to the photosensitive drum 1, which may cause problems of the image, such as low density and banding.

Thus, the first embodiment is more effective in reducing defective images than the comparative example.

Overview of First Embodiment

In summary, the first embodiment is allowed to dispose the ends of the magnetic-field generation member (the magnet roller 3*a*) inside the end sealing members 3*f* by adopting the magnetic contact developing method, thus solving the problems of the magnetic non-contact developing method. In other words, the first embodiment can prevent the toner t from entering the gaps between the end sealing members 3*f* and the developing sleeve 3*b* while preventing the generation of fogging, thus preventing the toner t from leaking outside the developing unit 3.

The magnet roller 3*a* and the shaft 3*j* (see FIG. 4A) are sometimes integrated into a single unit. In this case, the shaft 3*j* may also generate a magnetic field. However, the influence of the magnetic field that the shaft 3*j* having a diameter smaller than that of the magnet roller 3*a* generates on the surface of the developing sleeve 3*b* is remarkably small. A portion that generates an actually effective magnetic field (magnetic-field generation area) may be only the magnet roller 3*a*. In other words, also in the case where the magnet roller 3*a* is integrated with the shaft 3*j* and the case where the shaft 3*j* generates a magnetic field in the first embodiment, the ends of the magnetic-field generation member and the ends of the magnetic-field generation area refer to the ends of the magnet roller 3*a*. The ends of the magnetic-field generation member and the ends of the magnetic-field generation area do not refer to the ends of the support (shaft 3*j*) of the magnet roller 3*a*.

Although the magnetic-field generation member (the magnet roller 3*a*) in the first embodiment is a cylindrical member, the shape of the magnetic-field generation member is not limited to be cylindrical.

The fixation of the toner t on the developing sleeve 3*b* at the positions of the end sealing members 3*f* is caused by a friction due to the contact of the toner t with the developing sleeve 3*b* and the end sealing members 3*f*. Thus, the fixation of the toner t is more prone to occur as the time during which the developer container 3*e* is used increases, thus being more prone to occur during the last half of the life of the developer container 3*e*.

The distance between the ends of the magnet roller 3*a* and the inside of the end sealing members 3*f* in the longitudinal direction, that is, the length of the magnet roller 3*a* in the longitudinal direction, can be adjusted. This allows the magnitude of the magnetic force on the developing sleeve 3*b* to be controlled at the positions of the end sealing members 3*f*. The magnitude may be controlled depending on the life of the developing unit 3.

If the developing unit 3 has a long life, the magnet roller 3*a* may be set short to separate the ends of the magnet roller 3*a* from the inside of the end sealing members 3*f*. This can enhance the function of preventing the fixation of the toner t.

Particularly in the first embodiment, the magnet roller 3*a* is set further shorter than the length of the opening 3*g* of the developer container 3*e* to reliably separate the ends of the magnet roller 3*a* from the end sealing members 3*f*. In other words, the ends of the magnet roller 3*a* are located inside the ends of the opening 3*g* in the longitudinal direction of the developing sleeve 3*b*.

Second Embodiment

In a second embodiment, another method for decreasing the magnetic force on the developing sleeve 3*b* at the positions of the end sealing members 3*f* will be described. Substantially the entire area of the magnet roller 3*a* used in the first embodiment serves as an area that generates a magnetic field (a magnetic-field generation area); in contrast, the second embodiment is characterized by using a magnet roller 3*i* only part of which serves as a magnetic-field generation area.

The magnet roller 3*i* used in the second embodiment has magnetic powder and a resin binder as the main components. The magnet roller 3*i* is manufactured, magnetized, and oriented by injecting these melted materials into a production die in which a magnet is disposed. Setting the magnetizing and orienting magnet in the production die shorter than the longitudinal length of the magnet roller 3*i* allows the longitudinal range (width) of magnetization of the magnet roller 3*i* to be changed.

Figure 6A:
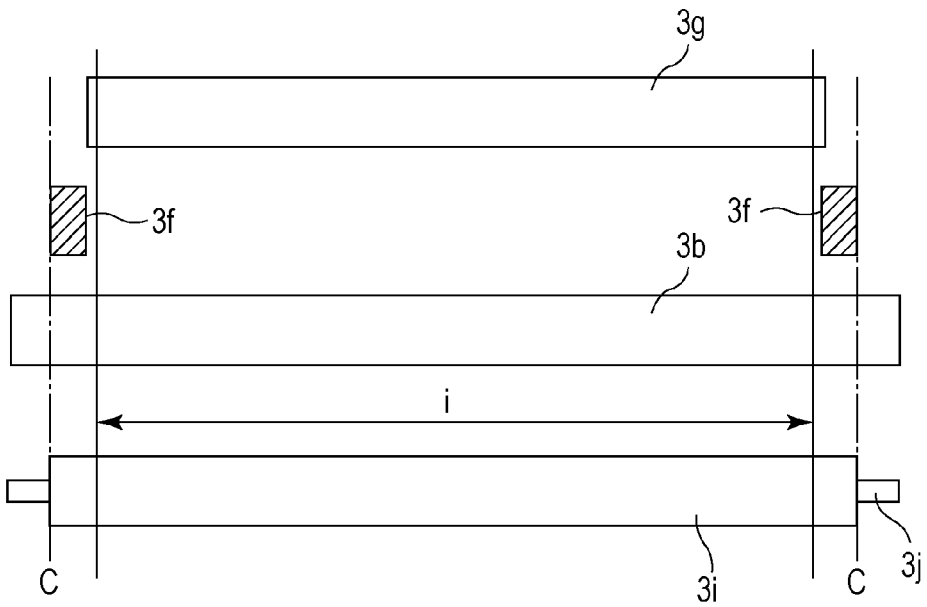
FIG. 6A is a diagram illustrating the positions of the components of a developing unit according to a second embodiment.
Figure 6B:
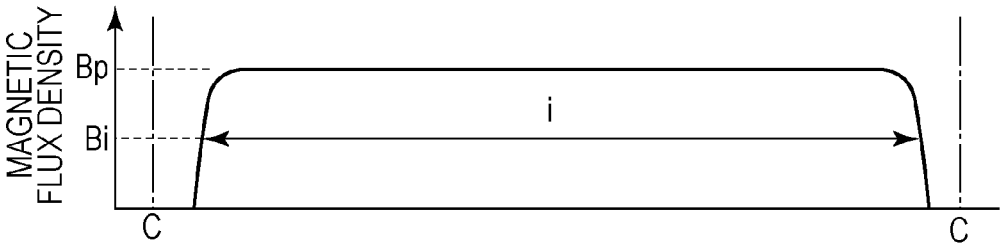
FIG. 6B is a diagram illustrating a magnetic flux density in the second embodiment.

FIGS. 6A and 6B are diagrams illustrating the relationship between the longitudinal positions of the components and the magnetic flux density on the surface of the developing sleeve 3*b* in the second embodiment. In the second embodiment, there is no correlation between the longitudinal length of the magnet roller 3*i* (the distance between C and C in FIG. 6A) and the longitudinal distribution of the magnetic flux density. The longitudinal distribution of the magnetic flux density is set by changing the longitudinal magnetized area of the magnet roller 3*i* (a magnetic-field generation area i). This allows the magnetic force exerted on the toner t to be decreased in the vicinity of the end sealing members 3*f*.

In the second embodiment, an area in which the magnetic flux density falls within 50% of a maximum value Bp of the magnetic flux density generated by the magnet roller 3*i*, which is measured on the surface of the developing sleeve 3*b*, is defined as the magnetic-field generation area i. In other words, a position Bi in which the magnetic flux density is decreased in half to 50% of the maximum value Bp (half position) is defined as an end of the magnetic-field generation area i.

In the second embodiment, the length of the area of the magnet roller 3*i* that generates a magnetic field (the magnetic-field generation area i) is shorter than the distance between the two end sealing members 3*f* disposed at both ends of the opening 3*g*.

In other words, the ends of the magnetic-field generation area i are located inside the inner ends of the end sealing members 3*f* in the longitudinal direction of the developing sleeve 3*b*.

This decreases the magnetic force exerted from the magnet roller 3*i* onto the toner t at the positions of the end sealing members 3*f*. In other words, the force that holds the toner on the developing sleeve 3*b* is decreased at the positions. Furthermore, since the toner t is attracted to a larger magnetic force, it difficult for the toner t on the developing sleeve 3*b* to reach the positions of the end sealing members 3*f*. In other words, the magnetic-field generation area i substantially corresponds to an area that can bear the toner t on the surface of the developing sleeve 3*b* with the magnetic force of the magnet roller 3*i* (a developer bearing area). The ends of the area in which the toner is born on the developing sleeve 3*b* with the magnetic force of the magnet roller 3*i* are located inside the inner ends of the end sealing members 3*f*.

This decreases the amount of toner t that enters the gaps between the end sealing members 3*f* and the developing sleeve 3*b*. This can prevent the toner t from leaking from between the end sealing members 3*f* and the developing sleeve 3*b* to the outside of the developing unit 3. This can also prevent the toner t from being fixed between the end sealing members 3*f* and the developing sleeve 3*b*, thus reliably preventing the toner t from leaking with the end sealing members 3*f*.

Also in the second embodiment, the magnitude of the magnetic force on the developing sleeve 3*b* at the positions of the end sealing members 3*f* may be controlled depending on the life of the developing unit 3. If the developing unit 3 has a long life, the magnetic-field generation area i may be decreased in length, so that the magnetic force of the magnet roller 3*i* acting at the positions of the end sealing members 3*f* becomes as small as possible. This can enhance the function of preventing the fixation of the toner t.

Particularly in the second embodiment, to reliably separate the ends of the magnetic-field generation area i of the magnet roller 3*i* from the end sealing members 3*f*, the magnetic-field generation area i is set slightly shorter than the length of the opening 3*g* of the developer container 3*e*. In other words, the ends of the magnetic-field generation area i are located inside the ends of the opening 3*g* in the longitudinal direction. In other words, the ends of the developer bearing area in which the toner t is born on the developing sleeve 3*b* by the magnetic force of the magnet roller 3*i* are located slightly inside the ends of the opening 3*g*. This can reliably reduce leakage of the toner t born on the developing sleeve 3*b* from between the developing sleeve 3*b* and the end sealing members 3*f* to the outside of the developing unit 3.

The second embodiment also adopts the contact developing method that performs development by keeping the developing sleeve 3*b* in contact with the photosensitive drum 1, as in the first embodiment. This can prevent the generation of a defective image in the vicinity of the end sealing members 3*f* even if the magnetic force of the magnet roller 3*i* is decreased at the positions of the end sealing members 3*f* in contrast to the non-contact developing method.

In the second embodiment, the density of the magnetic flux that the magnet roller 3*i* generates is measured at a position where the developing sleeve 3*b* opposes the photosensitive drum 1, that is, the developing section a (see FIG. 1), with which the magnetic-field generation area i is defined. In other words, the density of a magnetic flux that the magnetic pole (in the second embodiment, S-pole) of the magnet roller 3*a* closest to the photosensitive drum 1 is measured, and the result is used.

Alternatively, the distribution of the magnetic flux density in the longitudinal direction of the magnet roller 3*a* has the same tendency as that of the magnetic-field generation area i also for the other S-pole and N-pole of the magnet roller 3*a*.

Third Embodiment

The first embodiment uses wool felt that is in contact with the developing sleeve 3*b* as the end sealing members 3*f*. The use of the end sealing members 3*f* in contact with the developing sleeve 3*b* may cause the toner t to be fixed to the developing sleeve 3*b* due to the friction between the developing sleeve 3*b* and the end sealing members 3*f*. Thus, it is particularly effective to decrease the length of the magnet roller 3*a*, thereby reducing the amount of toner t entering the gaps between the developing sleeve 3*b* and the end sealing members 3*f*.

However, decreasing the length of the magnet roller 3*a* is effective also for a configuration in which end sealing members are not in contact with the developing sleeve 3*b*. Thus, a third embodiment uses magnets (magnetic sealing members 3*h*) disposed at a predetermined distance from the developing sleeve 3*b* as end sealing members. The third embodiment will be described with reference to FIG. 7. Description of a configuration common to the first and second embodiments will be omitted.

Figure 7:
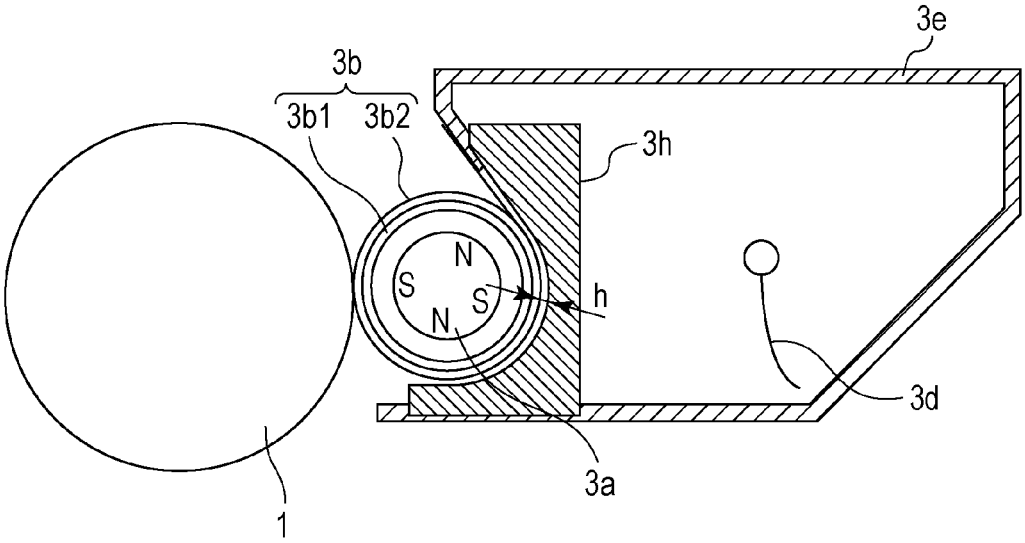
FIG. 7 is a schematic cross-sectional view of a process cartridge according to a third embodiment.

FIG. 7 is a schematic cross-sectional view of a process cartridge. In the third embodiment, the magnetic sealing members 3*h* are disposed at a predetermined distance h from the developing sleeve 3*b*, as described above. The magnetic sealing members 3*h* are magnets. The magnetic sealing members 3*h* are sealing members (end sealing members) that seal the gap between the ends of the developing sleeve 3*b* and the developer container 3*e* so as to prevent the toner t from leaking therethrough. The magnetic sealing members 3*h* prevent the toner t that has entered the gaps between the developing sleeve 3*b* and the magnetic sealing members 3*h* from leaking to the outside of the developing unit 3 by attracting the toner t with a magnetic force.

Also in the third embodiment, disposing the ends of the magnet roller 3*a* inside the magnetic sealing members 3*h* by decreasing the length of the magnet roller 3*a*, as in the first embodiment, decreases the amount of toner t entering the gaps between the developing sleeve 3*a* and the magnetic sealing members 3*h*. This is a configuration using the magnetic sealing members 3*h* instead of the end sealing members 3*f* of the first embodiment in FIG. 4A. This prevents a large amount of toner t from entering the gaps between the magnetic sealing members 3*h* and the developing sleeve 3*a*, thus preventing the toner t from leaking outside the developing unit 3 more reliably.

Alternatively, as in the second embodiment, reducing the magnetic-field generation area i by using the magnet roller 3*i* to dispose the ends of the magnetic-field generation area i (the developer bearing area) inside the magnetic sealing members 3*h* also offers the same advantage. This is a configuration in which the magnetic sealing members 3*h* are disposed instead of the end sealing members 3*f* in FIG. 6A.

The third embodiment also adopts the contact developing method, as in the first and second embodiments. This can prevent generation of a defective image in the vicinity of the magnetic sealing members 3*h* even if the magnetic force of the magnet roller 3*a* is decreased in the vicinity of the magnetic sealing members 3*h* in contrast to the non-contact developing method.

Fourth Embodiment

A fourth embodiment will be described.

The fourth embodiment also has the magnetic sealing members 3*h* in the vicinity of the developing sleeve 3*b* to prevent leakage of the toner t from the vicinity of the ends of the developing sleeve 3*b* to the outside, that is, toner leakage, as in the third embodiment. A configuration different from the third embodiment will be particularly described in detail.

The fourth embodiment is characterized in the dimensional and positional relationship among the magnetic sealing members 3*h*, the regulating blade 3*c*, and the magnet roller 3*a*.

First, the ends of the opening 3*g* of the developer container 3*e* will be described with reference to FIGS. 8A to 8C. To describe the ends of the developing unit 3, the developing sleeve 3*b* is omitted in FIGS. 8A and 8B. FIG. 8C is a diagram in which the developing sleeve 3*b* is disposed.

Figure 8A:
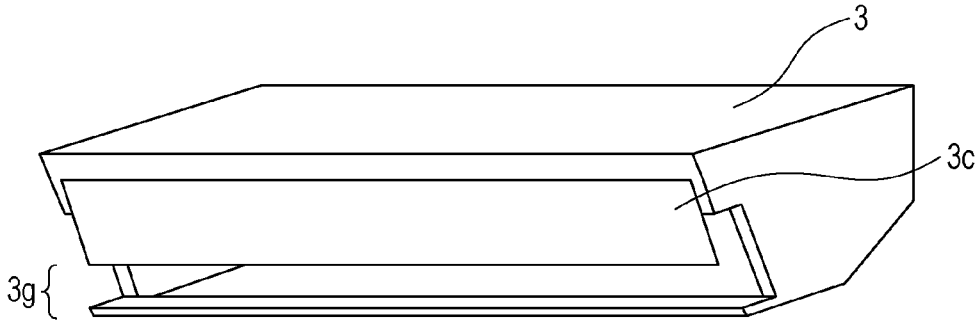
FIG. 8A is a diagram illustrating, in outline, the configuration of a developing unit.
Figure 8B:
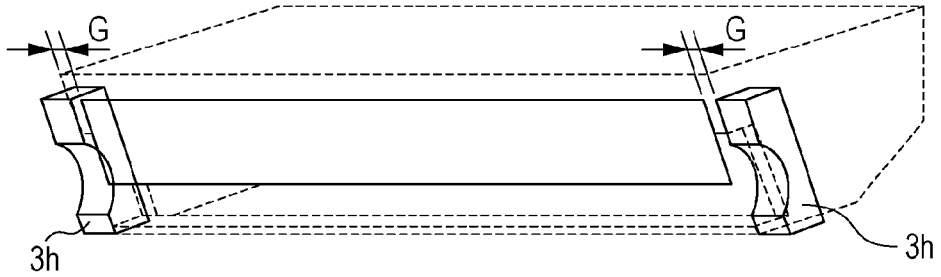
FIG. 8B is a diagram illustrating, in outline, the configuration of the developing unit.
Figure 8C:
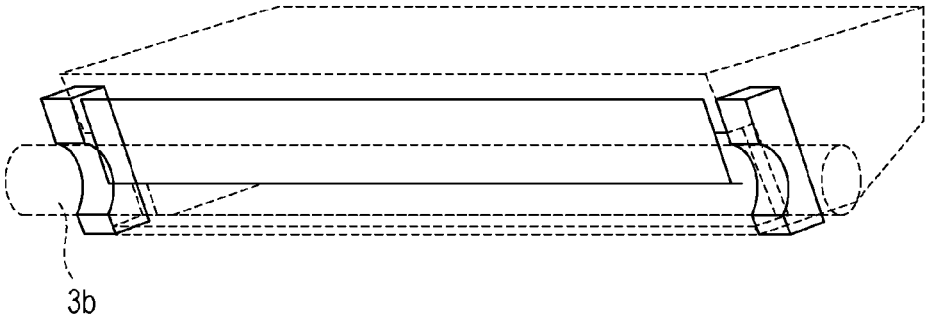
FIG. 8*c* is a diagram illustrating, in outline, the configuration of the developing unit.

As shown in FIG. 8A, the developing unit 3 has the opening 3*g*, to which the toner t is conveyed by the magnetic force of the magnet roller 3*a* and the stirring member 3*d*. The sealing members 3*h* are disposed at the ends of the opening 3*g*, as shown in FIG. 8B. The toner t, which is magnetic toner, is held between the magnetic sealing members 3*h* and the surface of the developing sleeve 3*b* by the magnetic force generated from the magnetic sealing members 3*h*. This ensures the developer sealing performance, thereby preventing the toner t from leaking out of the developer container 3*e*. Furthermore, although the sides of the magnetic sealing members 3*h* are disposed close to both end faces of the regulating blade 3*c*, no small gaps G are generated between the sides (inner ends) of the magnetic sealing members 3*h* and the ends of the regulating blade 3*c*. This is because the magnetic sealing members 3*h* are rigid, and thus, it is difficult to dispose the magnetic sealing members 3*h* in contact with the regulating blade 3*c*.

Sizes and Displacement of Components in Fourth Embodiment

Figure 9A:
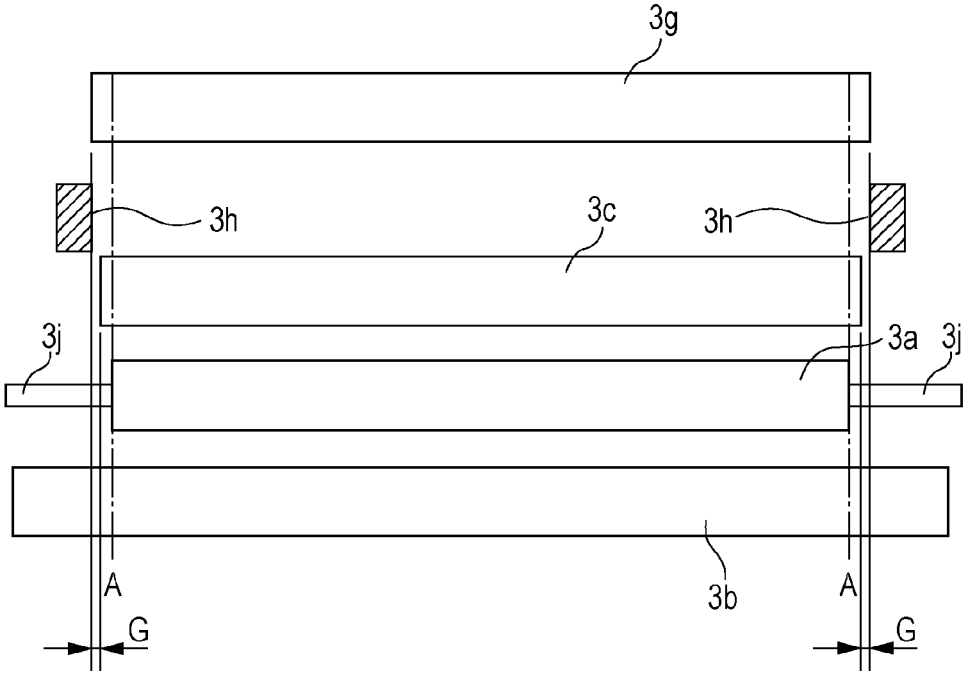
FIG. 9A is a diagram illustrating the positions of the components of a developing unit according to a fourth embodiment.
Figure 9B:
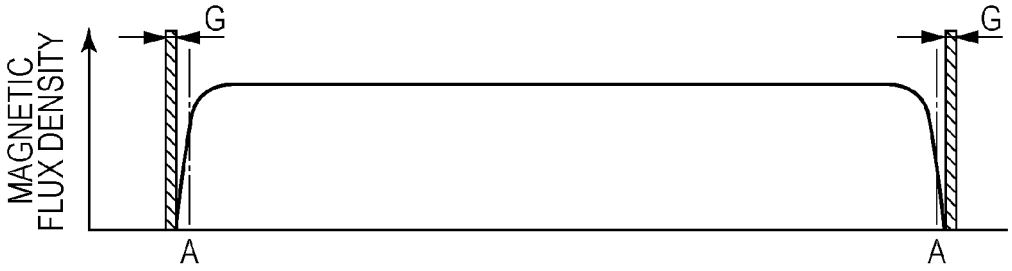
FIG. 9B is a diagram illustrating a magnetic flux density in the fourth embodiment.

FIGS. 9A and 9B are diagrams illustrating the positional relationship between the longitudinal positions and the magnetic force in the fourth embodiment. FIG. 9A shows the longitudinal positional relationship among the opening 3*g*, the magnetic sealing members 3*h*, the developing sleeve 3*b*, the magnet roller 3*a*, and the regulating blade 3*c*. Reference sign 3*j* in FIG. 9A denotes the shaft of the magnet roller 3*a*, which serves as a support for supporting the magnet roller 3*a* in the developer container 3*e* (see FIG. 1). In other words, the shaft 3*j* is fixed to the developer container 3*e*, so that the magnet roller 3*a* is fixed to the developer container 3*e*.

FIG. 9B shows the positional relationship between the magnetic flux density of the magnet roller (in teslas) and the longitudinal distribution thereof. This shows the measurements of the density of a magnetic flux generated at the developing section a (see FIG. 1) on the surface of the developing sleeve 3*b*.

The fourth embodiment is characterized in that the ends of the magnet roller 3*a* are disposed inside the ends of the regulating blade 3*c* by setting the magnet roller 3*a* shorter than the regulating blade 3*c* in the longitudinal direction of the developing sleeve 3*b*. This prevents the toner t from being excessively born at the ends of the developing sleeve 3*b*, thereby preventing the generations of a defective image. This will be described hereinbelow.

The distribution of the magnetic force is decreased outside the longitudinal ends of the magnet roller 3*a* (A in FIG. 9A). This characteristic is common to the longitudinal magnetic distribution of the developing section a, the conveying section, the supply section, and the collecting section. As described above, the toner t is conveyed over the developing sleeve 3*b* while receiving the magnetic force of the magnet roller 3*a*. Thus, the amount of the toner t on the developing sleeve 3*b* depends also on the magnitude of the magnetic force. The amount of the toner t decreases as the magnetic force decreases.

In the fourth embodiment, the longitudinal ends of the magnet roller 3*a* are located inside the ends of the regulating blade 3*c*, as shown in FIG. 9A. Since the fourth embodiment has a configuration in which the gaps G between the sides of the magnetic sealing members 3*h* and the ends of the regulating blade 3*c* and the magnet roller 3*a* do not overlap, the magnetic force of the magnet roller 3*a* generated on the developing sleeve 3*b* decreases in the gaps G. The decrease in the magnetic force decreases the force of holding the toner t on the developing sleeve 3*b*. Since the toner t is attracted to a stronger magnetic force, it is difficult for the toner t to reach the gaps G. In other words, the amount of toner t supplied from the developer container 3*e* to the developing sleeve 3*b* decreases at areas corresponding to the gaps G.

As described above, since the regulating blade 3*c* is not present in the areas corresponding to the gaps G, the amount of toner t to be born on the developing sleeve 6*b* cannot be regulated by the regulating blade 3*c*. The fourth embodiment therefore does not have the magnet roller 3*a* in the areas corresponding to the gaps G, thereby reducing the amount of toner t to be supplied in these areas to the developing sleeve 3*b*.

This can prevent the toner t from being excessively born on the developing sleeve 3*b* even in the gaps G in which the regulating blade 3*c* is not disposed.

If the toner t is excessively born on the developing sleeve 3*b* outside the regulating blade 3*c*, so-called fogging in which the toner t is transferred also to a no-image portion (a portion in which no image is to be formed) can be generated. However, there is no possibility of generating fogging in the fourth embodiment, thus preventing the fogging of the toner t in the gaps G.

Difference Between Fourth Embodiment and Non-Contact Developing Method

The fourth embodiment can achieve the above relationship between the longitudinal length of the magnet roller 3*a* and the magnetic sealing members 3*h* by adopting the contact developing method.

With the non-contact developing method, if the surface of the developing sleeve has a portion acted upon by the magnetic force of the magnet, the force of bearing toner on the developing sleeve decreases. As a result, a larger amount of toner than a desired amount splashes from the developing sleeve toward the photosensitive drum. This causes a defective image, such as fogging (the toner adheres to a portion in which no image is to be formed). In other words, the non-contact developing method needs to dispose a long magnet roller in the developing sleeve so as not to form a portion at which the magnetic force of the magnet roller decreases on the developing sleeve. Therefore, the ends of the magnet roller cannot be disposed inside the ends of the regulating blade in contrast to the fourth embodiment.

In contrast, the fourth embodiment uses the contact developing method, not the conventional non-contact developing method, although using magnetic toner. With this contact developing method, the developing sleeve 3*b* is in contact with the photosensitive drum 1, as described above, and applies only a DC bias to the developing sleeve 3*b*. Since the photosensitive drum 1 and the developing sleeve 3*b* are in contact, an extremely larger electric field acts between the photosensitive drum 1 and the developing sleeve 3*b* than that of the non-contact developing method.

In other words, with the contact developing method, a dominant force for transferring the toner t onto the photosensitive drum 1 is an electric field, and the action of the magnetic force of the magnet roller 3*a* is smaller. Thus, the difference in the force acting on the toner t between a portion on which the magnetic force of the magnet roller 3*a* acts and a portion on which no magnetic force acts is small, and the difference in influence on fogging is also remarkably small.

If the developing bias and the like are appropriately set so as not to generate fogging at the center of the developing sleeve 3*b* in the longitudinal direction, there is a low possibility of generating fogging also in the areas of the gaps G in which the magnetic force of the magnet roller 3*a* decreases (areas outside the ends of the regulating blade 3*c*).

In other words, in the fourth embodiment, the ends of the magnet roller 3*a* can be disposed inside the ends of the regulating blade 3*c* by adopting the magnetic contact developing method instead of the conventional magnetic non-contact developing method. This can reduce the amount of the toner t born outside the ends of the regulating blade 3*c*, thus preventing the toner t outside the ends of the regulating blade 3*c* from transferring from the developing sleeve 3*b* to the photosensitive drum 1.

Comparative Example

Next, the positional relationship between the longitudinal length of the magnet roller 103*a* and the gaps G between the sides of the magnetic sealing members 3*h* and the ends of the regulating blade 3*c* is different from that of the fourth embodiment will be described using FIGS. 10A and 10B.

Figure 10A:
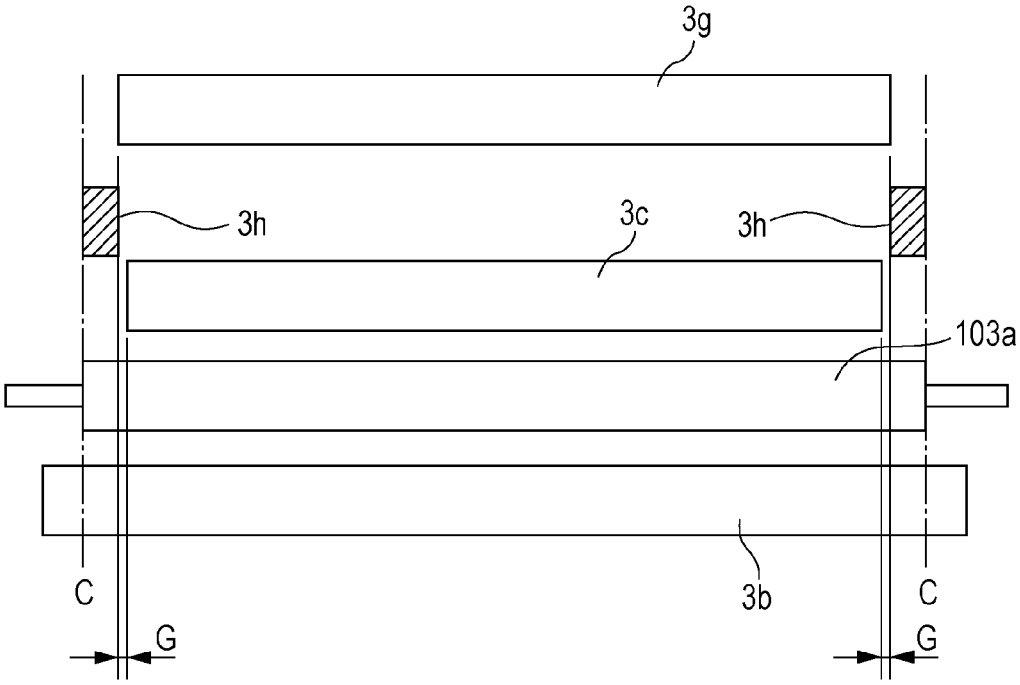
FIG. 10A is a diagram illustrating the positions of the components of a developing unit of a comparative example.
Figure 10B:
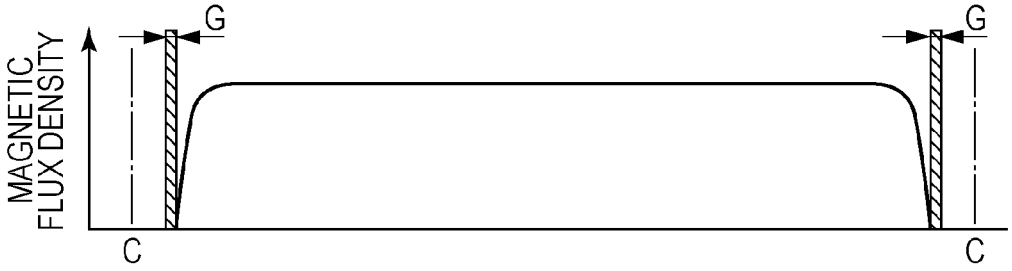
FIG. 10B is a diagram illustrating a magnetic flux density in the comparative example.

FIGS. 10A and 10B are diagrams illustrating the positional relationship between the longitudinal positions of the magnetic force in the comparative example. FIG. 10A shows the positional relationship among the opening 3*g*, the magnetic sealing members 3*h*, the developing sleeve 3*b*, the magnet roller 103*a*, and the regulating blade 3*c* in the longitudinal direction. FIG. 10B shows the magnetic flux density of the magnet roller 103*a* in the longitudinal direction of the developing sleeve 3*b* (in teslas).

In this comparative example, the ends of the magnet roller 103*a* are disposed outside the ends of the regulating blade 3*c* in contrast to the fourth embodiment. In other words, the magnet roller 103*a* is set longer than the regulating blade 3*c*.

The distribution of the magnetic force decreases in the areas outside the longitudinal ends (C in FIG. 10A) of the magnet roller 103*a*. This characteristic is common to the developing section a, the conveying section, the supply section, and the collecting section. As described above, the toner t is conveyed over the developing sleeve 3*b* while receiving the magnetic force of the magnet roller 103*a*. The toner t conveyed over the developing sleeve 3*b* is regulated by the regulating blade 3*c*.

Since the comparative example has the magnet roller 103*a* also in the gaps G, the developing sleeve 3*b* in these areas is also supplied with the toner t. However, the gaps G have no member for regulating the amount of the toner t on the developing sleeve 3*b* (the regulating blade 3*c* and the magnetic sealing members 3*h*). Thus, the developing sleeve 3*b* may excessively bear the toner t in the gaps G. This may make the toner t easily move from the developing sleeve 3*b* toward the photosensitive drum 1 in these portions, thus causing a defective image, such as fogging.

Thus, the fourth embodiment is more effective in reducing defective images than the comparative example.

Overview of Fourth Embodiment

In summary, the fourth embodiment is allowed to dispose the ends of the magnet roller 3*a* inside the ends of the regulating blade 3*c* by adopting the magnetic contact developing method, thus solving the problems of the magnetic non-contact developing method. In other words, the fourth embodiment can prevent the toner t from being excessively born on the developing sleeve 3*b* outside the ends of the regulating blade 3*c*.

In particular, the use of the magnetic sealing members 3*h* as end sealing members can form the gaps G between the regulating blade 3*c* and the magnetic sealing members 3*h*. Since the amount of the toner t on the developing sleeve 3*b* cannot be regulated in the gaps G, the configuration of the fourth embodiment is effective in reducing the amount of toner t supplied to the developing sleeve 3*b*.

The magnet roller 3*a* and the shaft 3*j* (see FIG. 9A) are sometimes integrated into a single unit. In this case, the shaft 3*j* may also generate a magnetic field. However, the influence of the magnetic field that the shaft 3*j* having a diameter smaller than that of the magnet roller 3*a* generates on the surface of the developing sleeve 3*b* is remarkably small. A portion that generates an actually effective magnetic field (magnetic-field generation area) may be only the magnet roller 3*a*. In other words, also in the case where the magnet roller 3*a* is integrated with the shaft 3*j* and the case where the shaft 3*j* generates a magnetic field in the first embodiment, the ends of the magnetic-field generation member and the ends of the magnetic-field generation area refer to the ends of the magnet roller 3*a*. The ends of the magnetic-field generation member and the ends of the magnetic-field generation area do not refer to the ends of the support (shaft 3*j*) of the magnet roller 3*a*.

Although the magnetic-field generation member (the magnet roller 3*a*) in the fourth embodiment is a cylindrical member, the shape of the magnetic-field generation member is not limited to be cylindrical.

Increasing the distance between the longitudinal ends of the magnet roller 3*a* and the gaps G is effective in reducing the amount of the toner t born on the developing sleeve 3*b* in the gaps G. Therefore, in the fourth embodiment, the magnet roller 3*a* is set shorter than the length of the opening 3*g* of the developer container 3*e*. In other words, the ends of the magnet roller 3*a* are located inside the ends of the opening 3*g* in the longitudinal direction of the developing sleeve 3*b*.

Alternatively, the regulating blade 3*c* may be sufficiently longer than the magnet roller 3*a*. However, this increases the size of the developing unit 3, and thus, the sizes and locations of the magnet roller 3*a*, the regulating blade 3*c*, and so on may be determined as appropriate in consideration of functions required for the developing unit 3.

Fifth Embodiment

In a fifth embodiment, another method for reducing the magnetic force of a magnet roller accommodated in the developing sleeve 3*b* in the gaps G between the sides of the magnetic sealing members 3*h* and the ends of the regulating blade 3*c*. Substantially the entire area of the magnet roller 3*a* used in the fourth embodiment serves as an area that generates a magnetic field (a magnetic-field generation area); in contrast, the fifth embodiment is characterized by using the magnet roller 3*i* only part of which serves as a magnetic-field generation area.

The magnet roller 3*i* has magnetic powder and a resin binder as the main components. The magnet roller 3*i* is manufactured, magnetized, and oriented by injecting these melted materials into a production die in which a magnet is disposed.

Setting the magnetizing and orienting magnet in the production die shorter than the longitudinal length of the magnet roller 3*i* allows the longitudinal range (width) of magnetization of the magnet roller 3*i* to be changed.

Figure 11A:
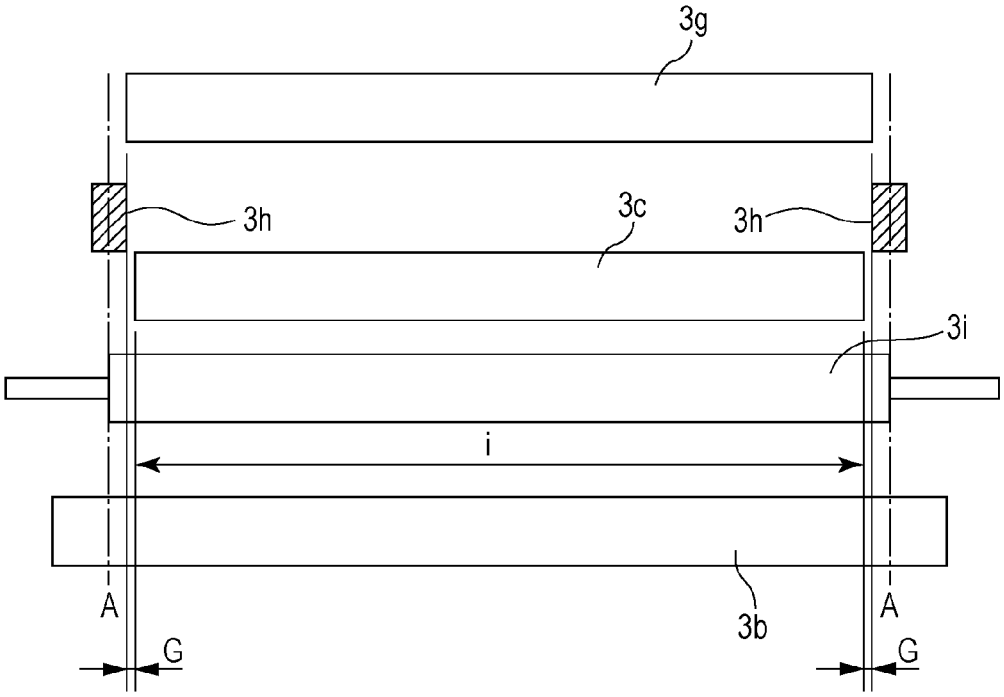
FIG. 11A is a diagram illustrating the positions of the components of a developing unit according to a fifth embodiment.
Figure 11B:
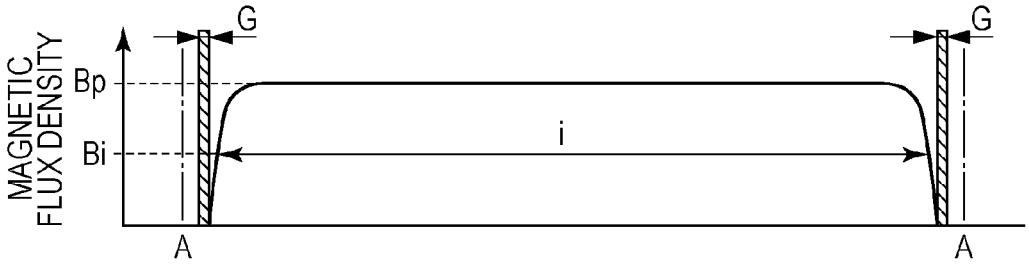
FIG. 11B is a diagram illustrating a magnetic flux density in the fifth embodiment.

FIGS. 11A and 11B are diagrams illustrating the positional relationship between the longitudinal positions and the magnetic force in the fifth embodiment. There is no correlation between the longitudinal length of the magnet roller 3*i* and the longitudinal distribution of the magnetic flux density. The longitudinal distribution of the magnetic flux density is set by changing the magnetized longitudinal area of the magnet roller 3*i* (the magnetic-field generation area i) so as to be decreased in the gaps G between the sides of the magnetic sealing members 3*h* and the ends of the regulating blade 3*c*. An area in which the magnetic flux density falls within 50% of a maximum value Bp of the magnetic flux density generated by the magnet roller 3*i*, which is measured on the surface of the developing sleeve 3*b*, is defined as the magnetic-field generation area i. In other words, a position Bi in which the magnetic flux density is decreased in half to 50% of the maximum value Bp (half position) is defined as an end of the magnetic-field generation area i.

In the fifth embodiment, the ends of the magnetic-field generation area i are located inside the gaps G. In other words, the ends of the magnetic-field generation area i are disposed inside the ends of the regulating blade 3*c* in the longitudinal direction of the developing sleeve 3*b*.

A decrease in the magnetic force that the magnet roller 3*i* generates in the vicinity of the magnetic sealing members 3*h* decreases the force of bearing the toner t on the developing sleeve 3*b*. Furthermore, the toner t is attracted to a stronger magnetic force, which makes it difficult for the toner t to move to the gaps G. This can prevent toner fogging in the gaps G.

This can prevent the toner t from moving outside the regulating blade 3*c*. To prevent the toner t from moving outside the regulating blade 3*c* more reliably, the ends of the magnetic-field generation area i may be disposed inside the ends of the opening 3*g*.

Sixth Embodiment

In the fourth and fifth embodiments, the magnetic sealing members 3*h* that are not in contact with the developing sleeve 3*b* are used as end sealing members. Since the magnetic sealing members 3*h* are rigid, it is difficult to dispose the magnetic sealing members 3*h* in contact with the regulating blade 3*c*, thus forming gaps between the magnetic sealing members 3*h* and the regulating blade 3*c*. Therefore, it is particularly effective to employ the magnet rollers 3*a* and 3*i* shown in fourth and fifth embodiments in the developing unit 3 using the magnetic sealing members 3*h*.

However, even if contact sealing members, such as wool felt, that are in contact with the developing sleeve 3*b* are used as end sealing members instead of the magnetic sealing members 3*h*, the configurations of the magnet roller 3*a* and the magnet roller 3*i* in the fourth and fifth embodiments can be used.

In other words, as shown in FIG. 2, the contact end sealing members 3*f* made of wool felt, which are in contact with the developing sleeve 3*b*, may also be used as sealing members. Also in this case, disposing the ends of the magnet roller 3*a* inside the ends of the regulating blade 3*c*, as in the fourth embodiment, can prevent the toner t from moving outside the regulating blade 3*c*. Alternatively, the magnet roller 3*i* may be used instead of the magnet roller 3*a*, and the ends of the, magnetic-field generation area i may be disposed inside the ends of the regulating blade 3*c*, as in the fifth embodiment.

The contact end sealing members 3*f* used in the sixth embodiment are soft in contrast to the magnetic sealing members 3*h* and thus can be disposed so that the ends of the contact end sealing members 3*f* and the ends of the regulating blade 3*c* overlap. In this case, the formation of gaps between the ends of the contact end sealing members 3*f* and the ends of the regulating blade 3*c* can be prevented. This can prevent the toner t from being born on the developing sleeve 3*b* at positions outside the regulating blade 3*c* more reliably.

On the other hand, the contact between the contact end sealing members 3*f* and the developing sleeve 3*b* can increase the torque necessary for rotating the developing sleeve 3*b*. Therefore, which to use as end sealing members, the magnetic sealing members 3*h* or the contact end sealing members 3*f*, may be determined as appropriate depending on the configuration of the developing unit 3. The use of the magnetic sealing members 3*h* as end sealing members generates gaps between the magnetic sealing members 3*h* and the developing sleeve 3*b*, thus eliminating the possibility that the magnetic sealing members 3*h* will interfere the rotation of the developing sleeve 3*b*.

Finally, the advantages of the first to sixth embodiments are summarized as follows. The configurations of the above embodiments can prevent the developer born on the developer bearing member from splashing or leaking. In other words, the configurations can prevent the developer born on the developer bearing member from moving to the image bearing member or leaking outside from between the developer bearing member and the sealing members.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-278518, filed Dec. 20, 2012, and No. 2012-278519, filed Dec. 20, 2012, which are hereby incorporated by reference herein in their entirety.

The invention claimed is:

1. A developing unit comprising:

a developer;

a developer container accommodating the developer;

a developer bearing member configured to bear the developer supplied from the developer container;

a magnetic-field generation member disposed in the developer bearing member, the magnetic-field generation member having a magnetic-field generation area generating a magnetic field for attracting the developer to the developer bearing member; and at least one sealing member disposed at the developer container, the sealing member being configured to prevent the developer from leaking from a gap between a longitudinal end of the developer bearing member and the developer container;

wherein an end of the magnetic-field generation area of the magnetic-field generation member is disposed inside an inner end of the sealing member in the longitudinal direction of the developer bearing member;

the developer is a magnetic one-component developer; and the developer bearing member develops a latent image formed on an image bearing member with the developer while keeping in contact with the image bearing member.

2. The developing unit according to claim 1, wherein the at least one sealing member comprises two sealing members provided at both ends of the developer container in the longitudinal direction; and the magnetic-field generation area is shorter than the distance between the two sealing members in the longitudinal direction.

3. The developing unit according to claim 1, further comprising an opening for supplying the developer from the interior of the developer container to the developer bearing member, wherein the magnetic-field generation area is shorter than the length of the opening in the longitudinal direction.

4. The developing unit according to claim 1, wherein an end of the magnetic-field generation member is disposed inside the inner end of the sealing member.

5. The developing unit according to claim 4, wherein the at least one sealing member comprises two sealing members provided at both ends of the developer container in the longitudinal direction; and the magnetic-field generation member is shorter than the distance between the two sealing members in the longitudinal direction.

6. The developing unit according to claim 4, further comprising an opening for supplying the developer from the interior of the developer container to the developer bearing member, wherein the magnetic-field generation member is shorter than the length of the opening in the longitudinal direction.

7. The developing unit according to claim 1, wherein the sealing member prevents the developer from leaking outside the developer container by being in contact with the longitudinal end of the developer bearing member.

8. The developing unit according to claim 1, wherein the sealing member is a magnet disposed with a certain gap from the developer bearing member, the sealing member attracting the developer with its magnetic force to prevent the developer from leaking outside the developer container.

9. The developing unit according to claim 1, wherein when the developing unit develops a latent image formed on the image bearing member, only a DC voltage is applied to the developer bearing member.

10. The developing unit according to claim 1, wherein the magnetic-field generation member is cylindrical in shape.

11. The developing unit according to claim 1, wherein the developer bearing member includes an elastic layer.

12. The developing unit according to claim 1, wherein the developer bearing member includes an electrically conductive elastic layer.

13. The developing unit according to claim 1, wherein the developer bearing member includes a non-magnetic electrically conductive elastic layer.

14. A developing unit comprising:

a developer;

a developer container accommodating the developer;

a developer bearing member configured to bear the developer supplied from the developer container;

a magnetic-field generation member disposed in the developer bearing member, the magnetic-field generation member having a magnetic-field generation area generating a magnetic field for attracting the developer to the developer bearing member;

at least one sealing member disposed at the developer container, the sealing member being configured to prevent the developer from leaking from a gap between a longitudinal end of the developer bearing member and the developer container; and a developer regulating member regulating the amount of the developer born on the developer bearing member;

wherein an end of the magnetic-field generation area of the magnetic-field generation member is disposed inside an end of the developer regulating member in the longitudinal direction of the developer bearing member;

the developer is a magnetic one-component developer; and the developer bearing member develops a latent image formed on an image bearing member with the developer while keeping in contact with the image bearing member.

15. The developing unit according to claim 14, wherein the magnetic-field generation area is shorter than the developer regulating member in the longitudinal direction.

16. The developing unit according to claim 14, further comprising an opening for supplying the developer from the interior of the developer container to the developer bearing member, wherein the magnetic-field generation area is shorter than the length of the opening in the longitudinal direction.

17. The developing unit according to claim 14, wherein an inner end of the sealing member is disposed outside an end of the developer regulating member in the longitudinal direction, and a gap is provided between the sealing member and the developer regulating member.

18. The developing unit according to claim 14, further comprising an opening for supplying the developer from the interior of the developer container to the developer bearing member, and the magnetic-field generation member is shorter than the length of the opening in the longitudinal direction.

19. The developing unit according to claim 14, wherein the sealing member is disposed with a certain gap from the developer bearing member, the sealing member attracting the developer with its magnetic force to prevent the developer from leaking outside the developer container.

20. The developing unit according to claim 11, wherein the sealing member prevents the developer from leaking outside the developer container by being in contact with the longitudinal end of the developer bearing member.

21. The developing unit according to claim 14, wherein when the developing unit develops a latent image formed on the image bearing member, only a DC voltage is applied to the developer bearing member.

22. The developing unit according to claim 14, wherein the developer bearing member includes an elastic layer.

23. The developing unit according to claim 14, wherein the developer bearing member includes an electrically conductive elastic layer.

24. The developing unit according to claim 14, wherein the developer bearing member includes a non-magnetic electrically conductive elastic layer.

25. The developing unit according to claim 14, wherein the magnetic-field generation area is an area in which a magnetic flux density measured on a surface of the developer bearing member is from 50% of a maximum value to the maximum value.

26. A process cartridge that can be attached to and detached from an image forming apparatus main body, the process cartridge comprising:

an image bearing member on which a latent image is formed; and a developing unit for developing the latent image, wherein the developing unit includes:

a developer;

a developer container accommodating the developer;

a developer bearing member configured to bear the developer supplied from the developer container;

a magnetic-field generation member disposed in the developer bearing member, the magnetic-field generation member having a magnetic-field generation area generating a magnetic field for attracting the developer to the developer bearing member; and at least one sealing member disposed at the developer container, the sealing member being configured to prevent the developer from leaking from a gap between a longitudinal end of the developer bearing member and the developer container;

wherein an end of the magnetic-field generation area of the magnetic-field generation member is disposed inside an inner end of the sealing member in the longitudinal direction of the developer bearing member;

the developer is a magnetic one-component developer; and the developer bearing member develops a latent image formed on the image bearing member with the developer while keeping in contact with the image bearing member.

27. The process cartridge according to claim 26, wherein the developer bearing member includes an elastic layer.

28. The process cartridge according to claim 26, wherein the developer bearing member includes an electrically conductive elastic layer.

29. The process cartridge according to claim 26, wherein the developer bearing member includes a non-magnetic electrically conductive elastic layer.

30. The process cartridge according to claim 26, wherein the magnetic-field generation area is an area in which a magnetic flux density measured on a surface of the developer bearing member is from 50% of a maximum value to the maximum value.

31. A process cartridge that can be attached to and detached from an image forming apparatus main body, the process cartridge comprising:

an image bearing member on which a latent image is formed; and a developing unit for developing the latent image, wherein the developing unit includes:

a developer;

a developer container accommodating the developer;

a developer bearing member configured to bear the developer supplied from the developer container;

a magnetic-field generation member disposed in the developer bearing member, the magnetic-field generation member having a magnetic-field generation area generating a magnetic field for attracting the developer to the developer bearing member;

at least one sealing member disposed at the developer container, the sealing member being configured to prevent the developer from leaking from a gap between a longitudinal end of the developer bearing member and the developer container; and a developer regulating member configured to regulate the amount of the developer born on the developer bearing member;

wherein an end of the magnetic-field generation area of the magnetic-field generation member is disposed inside an end of the developer regulating member in the longitudinal direction of the developer bearing member;

the developer is a magnetic one-component developer; and the developer bearing member develops a latent image formed on the image bearing member with the developer while keeping in contact with the image bearing member.

32. The process cartridge according to claim 31, wherein the developer bearing member includes an elastic layer.

33. The process cartridge according to claim 31, wherein the developer bearing member includes an electrically conductive elastic layer.

34. The process cartridge according to claim 31, wherein the developer bearing member includes a non-magnetic electrically conductive elastic layer.

35. The developing unit according to claim 1, wherein the magnetic-field generation area is an area in which a magnetic flux density measured on a surface of the developer bearing member is from 50% of a maximum value to the maximum value.

36. The process cartridge to claim 31, wherein the magnetic-field generation area is an area in which a magnetic flux density measured on a surface of the developer bearing member is from 50% of a maximum value to the maximum value.

* * * * *